United States Patent [19]

Gray

[11] 4,243,278

[45] Jan. 6, 1981

[54] LINEN TOWEL CABINETS

[75] Inventor: Douglas W. Gray, Chester, England

[73] Assignee: Saltney Engineering Company Limited, Deva Works, United Kingdom

[21] Appl. No.: 925,956

[22] Filed: Jul. 19, 1978

[30] Foreign Application Priority Data

Sep. 2, 1977 [GB] United Kingdom ..... 36734/77

[51] Int. Cl.[3] ..... B65H 19/00

[52] U.S. Cl. ..... 312/38; 242/55.53

[58] Field of Search ..... 312/38, 37, 39; 242/55.3, 55.53

[56] References Cited

U.S. PATENT DOCUMENTS

| | | | |
|---|---|---|---|
| 2,899,251 | 8/1959 | Birr | 312/38 |
| 3,563,623 | 2/1971 | Walton | 312/38 |

FOREIGN PATENT DOCUMENTS

| | | | |
|---|---|---|---|
| 815404 | 6/1959 | United Kingdom | 312/38 |

OTHER PUBLICATIONS

Steiner F-8 Towel Cabinet Brochures and Spare Parts List, published by Steiner Co., 5 Avenue Jurigoz, Lausanne, Switzerland.

*Primary Examiner*—Roy D. Frazier
*Assistant Examiner*—Alexander Grosz

[57] ABSTRACT

A mechanism for a towel cabinet including a frame, a rear roller arranged frictionally to engage a portion of dirty towel to be wound onto an idler roller, a front roller over which clean towel is entrained before passing over a pinch roller and emerging for withdrawal from the cabinet in which the mechanism is to be housed, and drive means between the front and rear rollers so that the latter is rotated by a different angular amount from the former on rotation of the former and including a stop arm rotatable with the rear roller each time a length of towel is withdrawn and a latch movable into engagement with the stop arm on rotation of the rear roller to prevent further rotation of the front roller and hence further towel withdrawal. A time-delay mechanism may be associated with the latch so that a further length of towel may be withdrawn after a predetermined interval of time. In one construction the stop arm can rotate at a different speed from the rear roller to enable alternative predetermined lengths of towel to be pulled from the cabinet as desired. In this construction a second drive means is provided between the front roller and stop arm.

28 Claims, 7 Drawing Figures

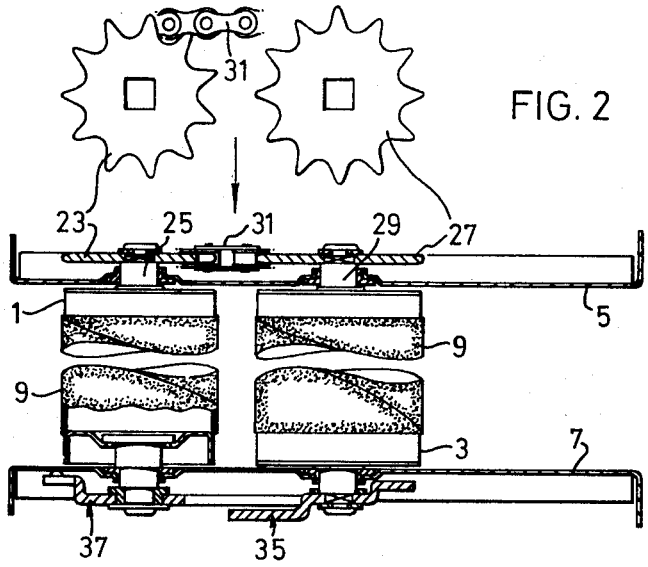
FIG. 2
FIG. 3
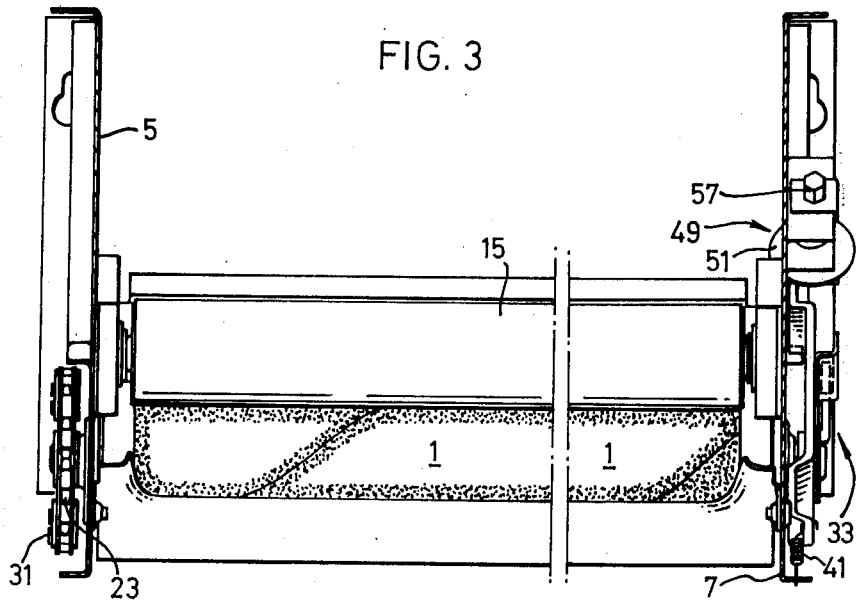

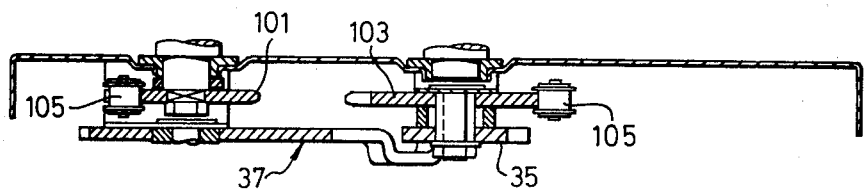
FIG. 7
FIG. 4
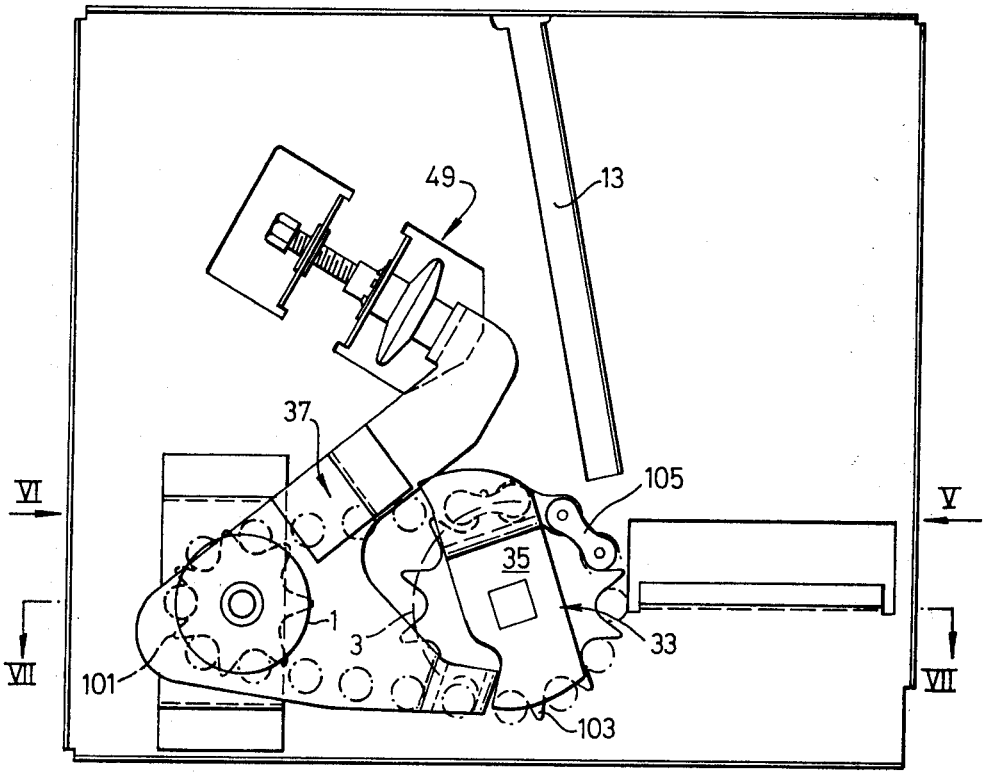

LINEN TOWEL CABINETS

This invention relates to an improved mechanism for linen towel cabinets of the type which incorporate pull down lengths of linen towel.

Linen towel cabinets have a mechanism therein to enable a user to withdraw a length of clean towel from a clean roll of towel freely supported in the base of the cabinet, the previously soiled towel being automatically rolled onto an idler roller which is frictionally engaged by a rear roller driven from the front roller every time a length of towel is withdrawn. In the known mechanism the towel, where it emerges from the cabinet, passes over a pinch roller which holds the towel against a front roller having a rough surface. This rough surface may be formed on the actual surface of the roller or may be provided by a piece of emery paper fitted onto the surface of the roller. A stop cam is keyed with the front roller to the front roller shaft and this stop cam has four or five stop positions. A stop latch is lifted by a device on the rear roller every time a length of towel is withdrawn so as to engage one of the teeth on the stop cam to prevent more than a predetermined length of towel being withdrawn.

With this construction the stop latch has to be lifted for every 90° or every 72° of rotation of the front roller. This means that as the rear roller rotates the stop latch has to be operated very quickly and hence large manufacturing tolerances are not acceptable. Also, of course, since rotation of the front roller is always stopped every 90° or 72°, its abrasive surface will become worn out at four or five locations quite rapidly.

We have now developed a new linen towel cabinet mechanism which considerably reduces the above-mentioned wear problem and which also means that considerably wider manufacturing tolerances are possible for the components of the stop mechanism. In one construction, we are able to regulate the amount of towel pulled out of the cabinet each time the towel is used.

According to the present invention, we provide a mechanism for a towel cabinet, said mechanism including a rear roller arranged frictionally to engage a portion of dirty towel which is to be wound onto an idler roller, a front roller over which clean towel may be entrained, before passing over a pinch roller and emerging for withdrawal from a cabinet in which the mechanism may be housed, drive means between the front and rear rollers so that the latter is rotated by a different angular amount from the former on rotation of the former, a stop arm rotatable with the rear roller each time a length of towel is withdrawn, and a latch movable into engagement with the stop arm on rotation of the rear roller to prevent further rotation of the front roller, thereby preventing further towel withdrawal.

Preferably, the mechanism also includes the idler roller for storing the dirty towel, and the pinch roller, the latter being mounted adjacent the front roller for pressing clean towel into engagement with the front roller and the former being located adjacent the rear roller.

Preferably, a time delay mechanism is associated with the latch so that after a predetermined period of time, e.g. 5 seconds, the latch can be moved out of engagement with the stop arm to enable a further length of towel to be withdrawn.

Preferably, the latch is mounted on one arm of a bell crank lever, the other arm supporting a cam roller and a portion of the time delay mechanism, the bell crank lever being biased to a position wherein the latch is normally pivoted out of the path of rotation of the stop arm.

Preferably, the stop arm has one end engageable with the latch and an opposite end which acts as a lifting cam which is engageable with the cam roller supported on the other arm of the bell crank lever, the arrangement being such that initial rotation of the stop arm will cause the lifting cam to engage the cam roller and rock the bell crank lever such that its latch moves into the path of rotation and hence into engagement with the one end of the stop arm, rocking movement of the bell crank lever causing the time delay mechanism to become operative to maintain the latch in its position of engagement with the stop arm to prevent further rotation of the front roller.

After a predetermined period of time, the time delay mechanism will become inoperative, whereby a spring will rock the bell crank lever to a position in which the latch is no longer in the path of movement of the stop arm, thus allowing the front roller to be rotated again.

Preferably, the time delay mechanism includes a pair of vacuum pads movable into and out of engagement with each other, one of the vacuum pads being mounted on a frame for the mechanism and the other being mounted on the other arm of the bell crank lever, there being adjustment means associated with the vacuum pad on the frame.

Preferably, the ratio of the diameter of the rear roller to the diameter of the front roller is 12:11 and a sprocket is associated with each roller, there being a chain entrained around the sprockets, the arrangement being such that for each revolution of the rear roller, the front roller will revolve 1 1/11 revolutions. Hence, the front roller will stop in 11 different positions before the stop positions are repeated.

In one construction, the stop arm is secured to the rear roller so as to rotate with the rear roller at the same speed as the rear roller. Preferably, with this construction, for each withdrawal of a length of clean towel, the rear roller, and hence the stop arm, is rotated 360°.

In an alternative construction, the stop arm does not rotate at the same speed as the rear roller but is capable of rotating about the same axis as the rear roller but relative thereto. In this construction, second drive means is provided between the front roller and the stop arm. Preferably, this second drive means comprises a second sprocket rotatable with and at the same speed as the front roller, a second sprocket rotatable with and at the same speed as the stop arm, and a chain entrained around said second sprockets. With this second drive means, it is possible, by changing the ratio of the second sprockets, to vary the amount of towel pulled out of the cabinet every time the towel is used.

Two preferred embodiments of linen towel cabinet mechanism are now described by way of example with reference to the accompanying drawings, in which:

FIG. 2 is a plan view of the mechanism shown in FIG. 1, parts of the mechanism having been omitted for the sake of clarity and part being in cross-section;

FIG. 3 is a front elevation of the mechanism of FIG. 1;

FIG. 4 is a view, similar to FIG. 1, of a second mechanism in which the amount of towel withdrawn from the cabinet can be regulated by changing the ratios of a second drive means between the front roller and stop arm;

FIG. 7 is a section on the line VII—VII in FIG. 4.

Figure 1:
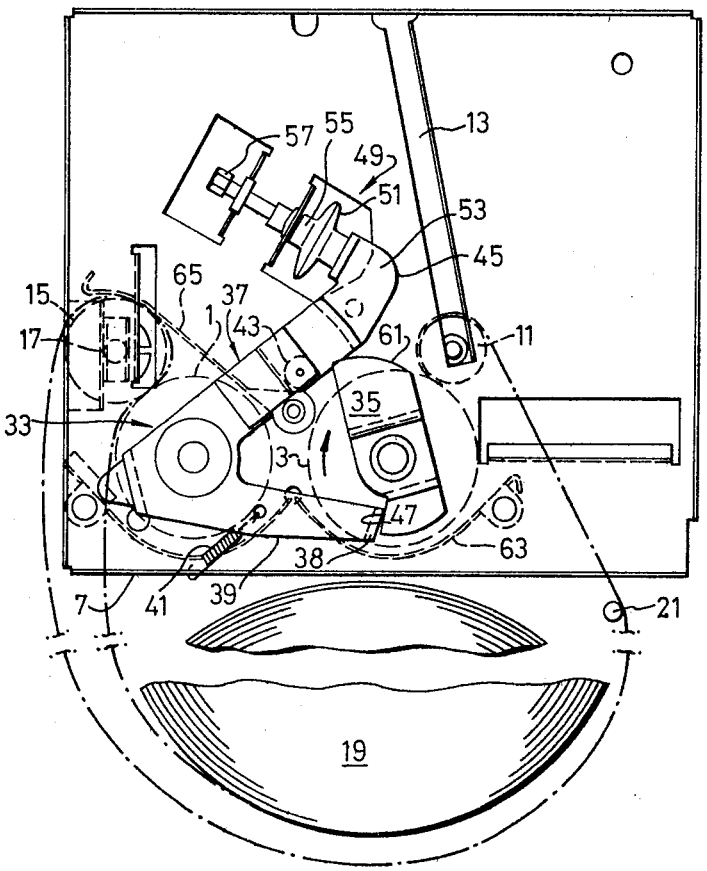
FIG. 1 is a side elevation of the mechanism of a first embodiment showing a clean towel threaded through the mechanism.
Figure 6:
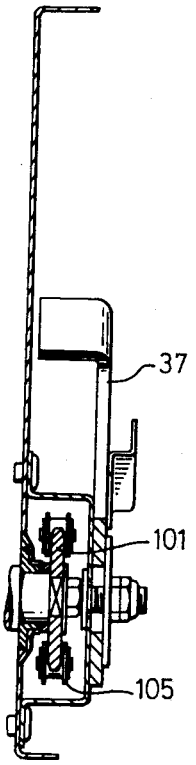
FIG. 6 is a scrap view looking in the direction of arrow VI in FIG. 4.
Figure 5:
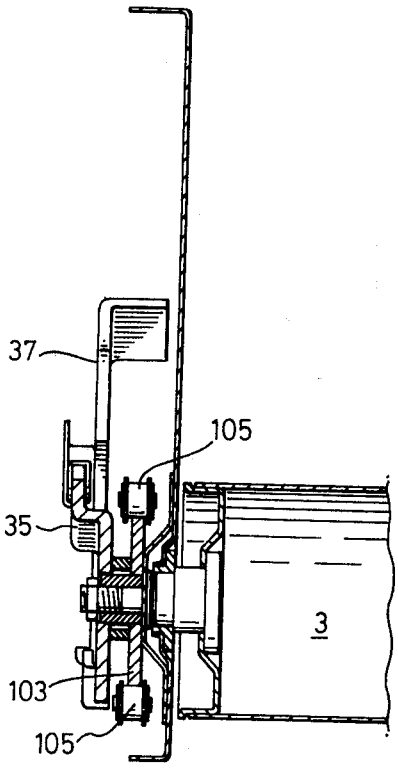
FIG. 5 is a scrap view looking in the direction of the arrow V in FIG. 4.

Referring to the drawings and in particular to FIGS. 1–3, the mechanism includes a front roller 1 and a rear roller 3, each of which is journalled in frame members 5 and 7 in known manner. The surface of each of the rollers 1 and 3 is rough and as shown each is provided with a sheet of emery paper 9 mounted thereon. It is an advantage to have removable sheets of emery paper 9 since these can be replaced when they have worn, but alternatively, the surface of the rollers themselves could be suitably roughened. An idler roller 11 onto which dirty towel can be wound is supported on swinging arms 13 depending from the frame members 5 and 7, the arrangement being such that the towel wound around the idler roller 11 will be frictionally engaged by the surface 9 of the rear roller 3 so that rotation of the rear roller will cause the towel to be wound upon the idler roller. A pinch roller 15 is rotatably supported above and forwardly of the front roller 1 in vertical slides 17 located on the frame members 5 and 7. Located beneath the front and rear rollers 1 and 3 is a storage cavity for a roll 19 of clean towel, the arrangement being such that in use the free end of the towel is entrained over the front surface of the front roller 1, around and over the pinch roller 15, out through a slot in the front of the towel casing (not shown) around the bottom of the casing in a loop and in through a slot in the rear lower end of the casing, back over a guide roller 21 and is then wound onto the idler roller 11. The idler roller is so arranged with its swinging arms 13 that it will bear under the forces of gravity against the rough surface of the rear roller 3.

The ratio of the diameter of the front roller to the rear roller is preferably 11:12. A front roller sprocket 23 is keyed onto a shaft 25 supporting the front roller 1 so as to rotate with the front roller and likewise a sprocket 27 is keyed onto a shaft 29 supporting the rear roller 3 to rotate with the latter. The sprocket 23 has eleven teeth, whereas the sprocket 27 has twelve teeth and an endless chain 31 is entrained around the two sprockets so that for every complete rotation of the rear roller 3 the front roller 1 will complete 1 1/11 rotations.

A roller stop mechanism indicated generally at 33 is supported on the external face of the frame member 7 and includes a stop arm 35 keyed to the shaft 29 for rotation therewith and a bell crank lever 37 freely rotatable about a horizontal axis corresponding to the rotational axis of the shaft 25. A latch 38 is provided on the end face of the arm 39 of the bell crank lever 37 and a spring 41 extends between the arm 39 and the frame member 7 normally to bias the latch 38 out of the path of rotation of the stop arm 35. A cam roller 43 is supported on the other arm 45 of the bell crank lever 37.

FIG. 1 shows the mechanism in the position it will occupy immediately at the end of withdrawal of a length of clean towel from the roller 19. In this position, the latch 38 will have been lifted (as will hereinafter be described) against the bias of the spring 41 into an operative position in which it engages a latch face 47 on the stop arm 35, thereby preventing rotation of the rear roller 3 and hence further withdrawal of the towel from the roller 19. This lifting movement will occur as the result of anti-clockwise rotation of the bell crank lever, and such rotation will move a time delay mechanism 49 into an operative position. The time delay mechanism includes a vacuum pad 51 on a kinked end 53 of the arm 45 and a further vacuum pad 55 supported on the frame member 7, there being a suitable time adjusting screw 57 associated with the vacuum pad 55. After a predetermined period of time which can be set by adjustment of the screw 57, the vacuum pad 51 will disengage itself from the vacuum pad 55 and allow the bell crank lever 37 to swing under the action of spring 41 from the position shown to the position in which the latch 38 no longer lies in the path of rotational movement of the latch face 47 on the stop arm 35. A further length of towel can now be withdrawn from the roll 19.

When an operator pulls down on the towel emerging from the slot in the front of the casing, this will cause the pinch roller 15 to rotate and the towel entrained around this will be advanced and cause rotation of the front roller 1 in a clockwise direction. This rotation will be imparted by the chain 31 to the rear roller 3 which will likewise rotate clockwise as shown by the arrow. The stop arm 35 will rotate with the rear roller 3 until a cam surface 61 on the end of the arm 35 remote from the latch surface 47 will have moved through approximately 270° and into engagement with the cam roller 43 on the arm 37. Continued rotation of the stop arm 35 will cause the roller 43 to move bodily upwardly thereby rocking the bell crank lever 37 anti-clockwise back into the position illustrated in which the latch 38 moves into the path of movement of latch surface 47 and the vacuum pads are moved back into engagement with each other to begin a further cycle.

As is traditional in the majority of linen towel cabinets, suitable baffle plates 63 and 65 are provided to keep soiled portions of the towel separate from clean portions.

From the foregoing, it will be appreciated that every time a length of towel is withdrawn from the supply 19 by a user, the rear roller 3 will rotate through one complete revolution, whereas the front roller will complete 1 1/11 revolutions. This means that there are eleven different stop positions of the front roller. This means that there are more than twice as many stop positions on the front roller as on all known machines, thereby reducing the wear on the front roller surface in comparison with known machines at least twofold. Furthermore, every time the towel has to be arrested, the rear roller will have completed one revolution and this means that the stop arm 35 and cam roller 43 need not be manufactured as accurately as in the known mechanisms where the stop mechanism is largely associated with the front roller. The ratio of 11:12 mentioned above is that most suitable for the majority of towel cabinets bearing in mind the location of the centres of the front and rear rollers and the maximum size of the two sprockets 23, 27. It will be appreciated, however, that different ratios could easily be adopted, e.g. 13:14 or 10:11.

In the embodiment of FIGS. 4–7 parts are identified with the same reference numerals as are used to identify the identical parts in the embodiment of FIGS. 1–3.

In this modified construction of towel cabinet, provision is made so that alternative predetermined lengths of towel may be pulled from the cabinet as desired. In the previous embodiment, the sprockets 23 and 27 were keyed to the roller shafts together with the rollers and the roller stop arm 35 was also keyed on the shaft of the rear roller 3. Furthermore, in the previously described embodiment the sprockets 23 and 27 were located on one side of the rollers, whereas the roller stop arm 35 and bell crank lever 37 were located on the opposite side. In the construction shown in FIGS. 4–7, the sprockets 23 and 27 are still provided on the opposite side of the rollers from the stop arm 35 and bell crank lever 37 but additional sprockets 101 and 103 are connected on the shaft for the front roller 1 and the shaft for the rear roller 3 respectively. The sprocket 101 is keyed with the shaft for the front roller 1 to rotate with the roller 1 but the sprocket 103 is freely rotatable on the shaft for the rear roller 3 so as to be capable of rotation relative to the rear roller 3. Furthermore, the roller stop arm 35 is keyed to the sprocket 103 to rotate therewith relative to the roller 3. This of course means that for a complete rotation through 360° of the rear roller 3 there will not necessarily be a complete rotation through 360° of the stop arm 35. By choosing a particular sprocket ratio between the sprockets 101 and 103, so the amount of towel which is withdrawn from the casing can be chosen. In the construction shown in FIG. 4 the front sprocket 101 has seven teeth, whereas the rear sprocket 103 has twelve teeth. The two sprockets are connected together by an endless chain 105.

When a length of towel is to be withdrawn from the cabinet the user will pull down on the towel presented at the front of the cabinet and the amount of towel that will be withdrawn will be determined by the ratio of the sprockets 101 and 103. The stop arm 35 will rotate through 360° as previously described when towel is pulled out and likewise sprocket 103 will rotate by the same amount. Because the sprocket 101 is connected to the sprocket 103 by the chain 105, the sprocket 101 on one rotation of the sprocket 103 will rotate 12/7 rotations if the sprocket ratios are 12:7. Of course, the towel which is pulled down will be wound back into the cabinet because, as was described with reference to the first embodiment, rotation of the front roller will automatically cause rotation of the rear roller. As before, for every rotation of the rear roller the front roller is arranged to rotate fractionally more than one complete revolution and the sprocket ratios effecting front and rear roller rotation are designed to compensate for the difference in the diameters of the front and rear rollers.

If it is desired to increase the length of towel being withdrawn from the cabinet at one pull, then the number of teeth on the sprocket 101 must be reduced, and vice versa.

What is claimed is:

1. A mechanism for a towel cabinet, said mechanism including a frame, a rear roller, means mounting said rear roller in said frame so that it is able frictionally to engage a portion of dirty towel which is to be wound onto an idler roller, a front roller, means mounting said front roller in said frame whereby clean towel may be entrained over said front roller before passing over a pinch roller and emerging for withdrawal from a cabinet in which the mechanism may be housed, drive means between said front and rear rollers so that said rear roller is rotated by a different angular amount from said front roller on rotation of said front roller, a stop arm rotatable with said rear roller each time a length of towel is withdrawn, and a latch movable into engagement with said stop arm on rotation of said rear roller to prevent further rotation of said front roller, thereby preventing further towel withdrawal wherein the stop arm does not rotate at the same speed as the rear roller but is capable of rotating about the same axis as said rear roller but relative thereto.

2. A mechanism according to claim 1 which also includes said idler roller for storing said dirty towel, and including said pinch roller and means mounting said pinch roller adjacent said front roller for pressing clean towel into engagement with said front roller and means locating said idler roller adjacent said rear roller.

3. A mechanism according to claim 1 and including a time delay mechanism associated with said latch so that after a predetermined period of time said latch can be moved out of engagement with said stop arm to enable a further length of towel to be withdrawn.

4. A mechanism according to claim 3, and including a bell crank lever, means mounting said latch on one arm of said bell crank lever, a cam follower and a portion of said time delay mechanism being supported on the other arm of said bell crank lever, and means biasing said bell crank lever to a position wherein said latch is normally pivoted out of the path of rotation of said stop arm.

5. A mechanism according to claim 4 wherein said stop arm has one end engageable with said latch and an opposite end which acts as a lifting cam which is engageable with said cam follower supported on the other arm of said bell crank lever, the arrangement being such that initial rotation of said stop arm will cause said lifting cam to engage said cam roller and rock said bell crank lever such that its latch moves into the path of rotation and hence into engagement with said one end of said stop arm, rocking movement of said bell crank lever causing said time delay mechanism to become operative to maintain said latch in its position of engagement with said stop arm to prevent further rotation of said front roller.

6. A mechanism according to claim 4 wherein, after a predetermined period of time, said time delay mechanism will become inoperative, whereby a spring will rock said bell crank lever to a position in which said latch is no longer in the path of movement of said stop arm, thus allowing said front roller to be rotated again.

7. A mechanism according to claim 4 wherein said time delay mechanism includes a pair of vacuum pads movable into and out of engagement with each other, means mounting one of said vacuum pads on said frame and means mounting the other vacuum pad on the other arm of said bell crank lever, there being adjustment means associated with the vacuum pad on said frame.

8. A mechanism according to claim 1 wherein the ratio of the diameter of said rear roller to the diameter of said front roller is 12:11 and wherein a sprocket is associated with each roller, there being a chain entrained around the sprockets, the arrangement being such that for each revolution of said rear roller, said front roller will revolve 1 1/11 revolutions.

9. A mechanism as claimed in claim 1 where for each withdrawal of a length of clean towel, said rear roller, and hence said stop arm, is rotated 360°.

10. A mechanism for a towel cabinet, said mechanism including a frame, a rear roller, means mounting said rear roller in said frame so that it is able frictionally to engage a portion of dirty towel which is to be wound onto an idler roller, a front roller, means mounting said front roller in said frame whereby clean towel may be entrained over said front roller before passing over a pinch roller and emerging for withdrawal from a cabinet in which the mechanism may be housed, drive means between said front and rear rollers so that said rear roller is rotated by a different angular amount from said front roller on rotation of said front roller, a stop arm rotatable with said rear roller each time a length of towel is withdrawn, and a latch movable into engagement with said stop arm on rotation of said rear roller to prevent further rotation of said front roller, thereby preventing further towel withdrawal and including a time delay mechanism associated with said latch so that after a predetermined period of time said latch can be moved out of engagement with said stop arm to enable a further length of towel to be withdrawn, and including a bell crank lever, means mounting said latch on one arm of said bell crank lever, a cam follower and a portion of said time delay mechanism being supported on the other arm of said bell crank lever, and means biasing said bell crank lever to a position wherein said latch is normally pivoted out of the path of rotation of said stop arm.

11. A mechanism according to claim 10 which also includes said idler roller for storing said dirty towel, and including said pinch roller and means mounting said pinch roller adjacent said front roller for pressing clean towel into engagement with said front roller and means locating said idler roller adjacent said rear roller.

12. A mechanism according to claim 10 wherein said stop arm has one end engageable with said latch and an opposite end which acts as a lifting cam which is engageable with said cam follower supported on the other arm of said bell crank lever, the arrangement being such that initial rotation of said stop arm will cause said lifting cam to engage said cam roller and rock said bell crank lever such that its latch moves into the path of rotation and hence into engagement with said one end of said stop arm, rocking movement of said bell crank lever causing said time delay mechanism to become operative to maintain said latch in its position of engagement with said stop arm to prevent further rotation of said front roller.

13. A mechanism according to claim 12 wherein, after a predetermintd period of time, said time delay mechanism will become inoperative, whereby a spring will rock said bell crank lever to a position in which said latch is no longer in the path of movement of said stop arm, thus allowing said front roller to be rotated again.

14. A mechanism according to claim 10 wherein said time delay mechanism includes a pair of vacuum pads movable into and out of engagement with each other, means mounting one of said vacuum pads on said frame and means mounting the other vacuum pad on the other arm of said bell crank lever, there being adjustment means associated with the vacuum pad on said frame.

15. A mechanism according to claim 10 wherein said stop arm is secured to the rear roller so as to rotate with the rear roller at the same speed as the rear roller.

16. A mechanism according to claim 10 wherein the ratio of the diameter of said rear roller to the diameter of said front roller is 12:11 and wherein a sprocket is associated with each roller, there being a chain entrained around the sprockets, the arrangement being such that for each revolution of said rear roller, said front roller will revolve 1 1/11 revolutions.

17. A mechanism according to claim 16 wherein the stop arm does not rotate at the same speed as the rear roller but is capable of rotating about the same axis as said rear roller but relative thereto.

18. A mechanism according to claim 17 wherein second drive means is provided between said front roller and said stop arm.

19. A mechanism according to claim 18 wherein said second drive means comprises a second sprocket rotatable with and at the same speed as said front roller, a second sprocket rotatable with and at the same speed as said stop arm, and a chain entrained around said second sprockets.

20. A mechanism as claimed in claim 16 wherein said stop arm is secured to the rear roller so as to rotate with the rear roller at the same speed as the rear roller.

21. A mechanism according to claim 20 wherein for each withdrawal of a length of clean towel, said rear roller, and hence said stop arm, is rotated 360°.

22. A mechanism for a towel cabinet, said mechanism including a frame, a rear roller, means mounting said rear roller in said frame so that it is able frictionally to engage a portion of dirty towel which is to be wound onto an idler roller, a front roller, means mounting said front roller in said frame whereby clean towel may be entrained over said front roller before passing over a pinch roller and emerging for withdrawal from a cabinet in which the mechanism may be housed, drive means between said front and rear rollers so that said rear roller is rotated by a different angular amount from said front roller on rotation of said front roller, a stop arm rotatable with said rear roller each time a length of towel is withdrawn, and a latch movable into engagement with said stop arm on rotation of said rear roller to prevent further rotation of said front roller, thereby preventing further towel withdrawal, the ratio of the diameter of said rear roller to the diameter of said front roller is 2:11 and wherein a sprocket is associated with each roller, there being a chain entrained around the sprockets, the arrangement being such that for each revolution of said rear roller, said front roller will revolve 1 1/11 revolutions, and wherein said stop arm does not rotate at the same speed as the rear roller but is capable of rotating about the same axis as said rear roller but relative thereto.

23. A mechanism according to claim 22 wherein second drive means is provided between said front roller and said stop arm.

24. A mechanism according to claim 23 wherein said second drive means comprises a second sprocket rotatable with and at the same speed as said front roller, a second sprocket rotatable with and at the same speed as said stop arm, and a chain entrained around said second sprockets.

25. A mechanism according to claim 22 and including a bell crank lever, means mounting said latch on one arm of said bell crank lever, a cam follower and a time delay mechanism having a portion supported on the other arm of said bell crank lever, and means biasing said bell crank lever to a position wherein said latch is normally pivoted out of the path of rotation of said stop arm.

26. A mechanism according to claim 22 and including a bell crank lever and means mounting said latch on one arm of said bell crank lever wherein said stop arm has one end engageable with said latch and an opposite end which acts as a lifting cam which is engageable with said cam follower supported on the other arm of said bell crank lever, the arrangement being such that initial rotation of said stop arm will cause said lifting cam to engage said cam roller and rock said bell crank lever such that its latch moves into the path of rotation and hence into engagement with said one end of said stop arm, rocking movement of said bell crank lever causing said time delay mechanism to become operative to maintain said latch in its position of engagement with said stop arm to prevent further rotation of said front roller.

27. A mechanism according to claim 26 wherein said stop arm is secured to the rear roller so as to rotate with the rear roller at the same speed as the rear roller.

28. A mechanism according to claim 22 wherein said stop arm is secured to the rear roller so as to rotate with the rear roller at the same speed as the rear roller.

* * * * *